US009751662B2

(12) United States Patent
Lee et al.

(10) Patent No.: US 9,751,662 B2
(45) Date of Patent: Sep. 5, 2017

(54) CONTAINER INTENDED FOR LIQUID AND HAVING A PRESSURE ADJUSTMENT SURFACE FOR CONSTANT DISCHARGE

(76) Inventors: Su-Jae Lee, Kyounggido (KR); Seong-Jae Lee, Seoul (KR)

( * ) Notice: Subject to any disclaimer, the term of this patent is extended or adjusted under 35 U.S.C. 154(b) by 300 days.

(21) Appl. No.: 14/412,934

(22) PCT Filed: Apr. 9, 2012

(86) PCT No.: PCT/KR2012/002666

§ 371 (c)(1),
(2), (4) Date: Jan. 5, 2015

(87) PCT Pub. No.: WO2012/138198

PCT Pub. Date: Oct. 11, 2012

(65) Prior Publication Data

US 2015/0203253 A1 Jul. 23, 2015

(30) Foreign Application Priority Data

Apr. 7, 2011 (KR) ..... 10-2011-0032393

(51) Int. Cl.
*B65D 35/24* (2006.01)
*B65D 1/02* (2006.01)
(Continued)

(52) U.S. Cl.
CPC ..... *B65D 35/24* (2013.01); *B65D 1/0223* (2013.01); *B65D 1/32* (2013.01); *B65D 35/44* (2013.01);
(Continued)

(58) Field of Classification Search
CPC .. B65D 47/2031; B65D 47/2018; B65D 1/32; B65D 1/40; B65D 25/38; B65D 47/20;
(Continued)

(56) References Cited

U.S. PATENT DOCUMENTS 2,688,424 A * 9/1954 Keiter ..... G01F 11/082 165/913
3,255,933 A * 6/1966 Martin ..... B05B 11/06 222/209
(Continued)

FOREIGN PATENT DOCUMENTS

JP 05-044134 U 6/1993
JP 10-024950 A 1/1998
(Continued)

OTHER PUBLICATIONS

International Search Report dated Dec. 31, 2012, mailed Jan. 2, 2013.

*Primary Examiner* — Paul R Durand
*Assistant Examiner* — Andrew P Bainbridge
(74) *Attorney, Agent, or Firm* — Norris McLaughlin & Marcus, P.A.

(57) ABSTRACT

A container for liquid, which discharges contents when the side surfaces thereof are pressed by the fingers. A coupling unit is assembled to the top of the container body so as to discharge the pressed contents. The coupling unit has an outlet comprising a check valve which opens/shuts by means of predetermined pressure. The coupling unit having the outlet is covered with a lid for protecting the outlet. The side surfaces of the container body have pressure adjustment surfaces that protrude inwardly. Predetermined gaps are maintained between the ends of the pressure adjustment surfaces and the side surfaces of the container body, located in front of the ends of the pressure adjustment surfaces.

6 Claims, 3 Drawing Sheets

(51) Int. Cl.

| | |
|---|---|
| ***B65D 1/32*** | (2006.01) |
| ***B65D 35/44*** | (2006.01) |
| *B65D 1/08* | (2006.01) |
| *B65D 47/18* | (2006.01) |
| *B65D 1/40* | (2006.01) |
| *B65D 47/20* | (2006.01) |
| *B65D 25/00* | (2006.01) |

(52) U.S. Cl.
CPC ..... *B65D 1/08* (2013.01); *B65D 1/40* (2013.01); *B65D 25/005* (2013.01); *B65D 47/18* (2013.01); *B65D 47/20* (2013.01); *B65D 47/2018* (2013.01); *B65D 47/2025* (2013.01)

(58) Field of Classification Search
CPC B65D 47/08; B65D 47/0804; B65D 47/0857; B65D 1/0223; B65D 1/02; B65D 1/08; B65D 25/005; B65D 35/24; B65D 35/44; B65D 47/18; B65D 47/2025
USPC ..... 222/212–215, 494–497, 562, 206, 556; 220/666, 669–675
See application file for complete search history.

(56) References Cited

U.S. PATENT DOCUMENTS 3,257,482 A * 6/1966 Schechter ..... B29C 47/062 264/45.1
4,394,134 A * 7/1983 Rowe ..... C10L 1/208 44/390
4,513,891 A * 4/1985 Hain ..... A61M 15/08 222/213
5,105,989 A * 4/1992 Gutkowski ..... B65D 47/0838 222/182
5,337,924 A * 8/1994 Dickie ..... B65D 1/32 215/383
5,603,436 A * 2/1997 Leoncavallo ..... B65D 47/0885 222/212
6,006,952 A * 12/1999 Lucas ..... A47G 19/2266 222/211
6,077,579 A * 6/2000 De Laforcade ..... A45D 33/18 206/459.1
6,170,712 B1 * 1/2001 Kasboske ..... B65D 1/32 222/107
7,753,240 B2 * 7/2010 Leoncavallo ..... B65D 47/0895 215/235
8,016,162 B2 * 9/2011 Cleary ..... B65D 1/0223 215/216
8,080,295 B2 * 12/2011 Kitzmiller ..... B29C 49/0073 220/62.22
8,894,312 B2 * 11/2014 Toh ..... A45D 34/041 401/209
8,915,403 B2 * 12/2014 Inaba ..... B65D 1/0223 222/215
2003/0222100 A1 * 12/2003 Husband ..... B65D 1/32 222/105
2008/0302830 A1 * 12/2008 Loth-Krausser ..... A61F 9/0008 222/215
2013/0048679 A1 * 2/2013 Swanick ..... B65D 47/0838 222/206
2014/0137650 A1 * 5/2014 Kleinert ..... G01N 29/043 73/628
2014/0305952 A1 * 10/2014 Harris ..... B65D 1/0292 220/666
2015/0343693 A1 * 12/2015 Nogueira ..... B65D 1/0246 264/537

FOREIGN PATENT DOCUMENTS

JP 2001-151284 A 6/2001
KR 10 2004 0099464 A 11/2004

* cited by examiner

[Fig. 1]
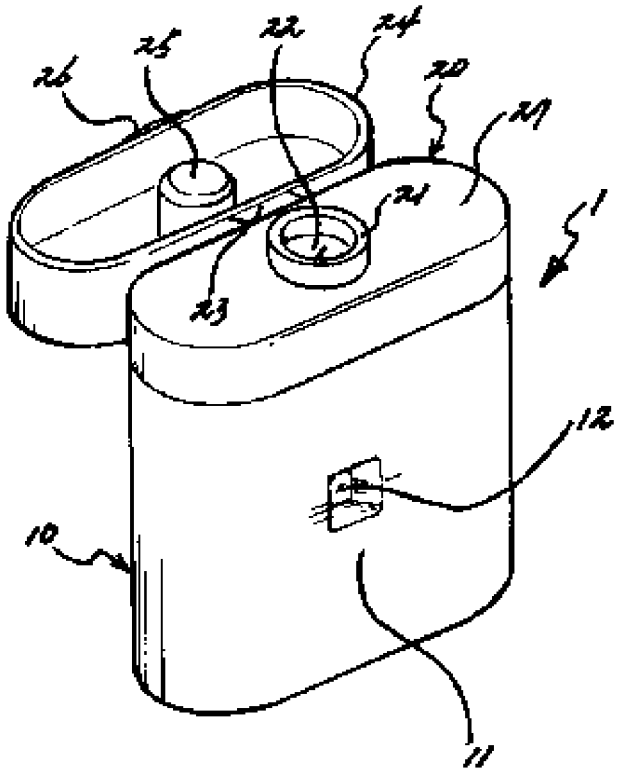
[Fig. 2]
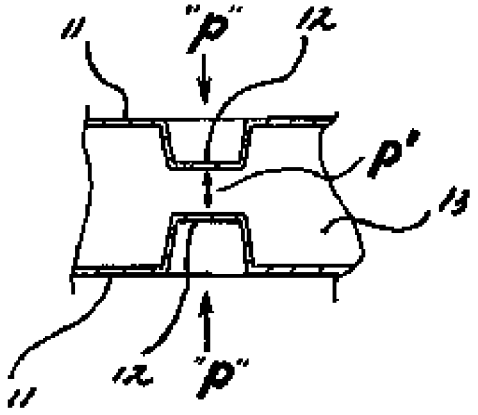

[Fig. 3]
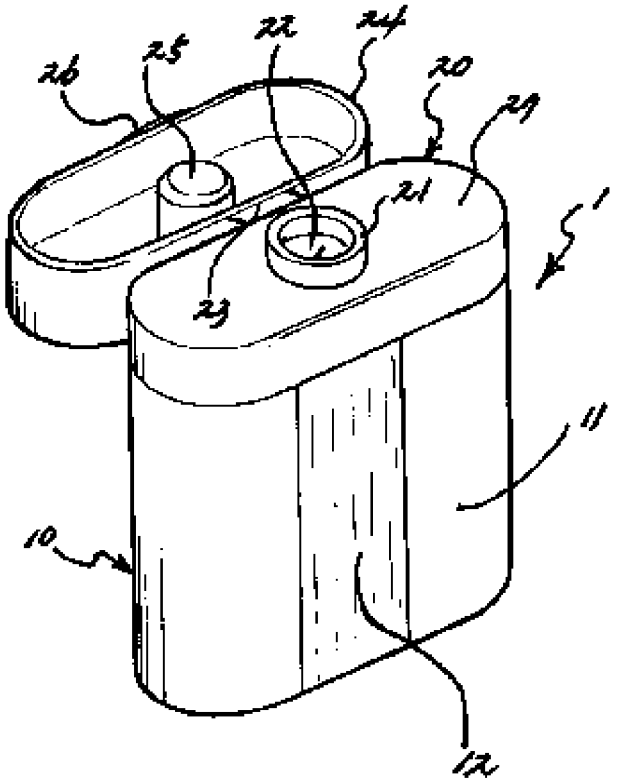
[Fig. 4]
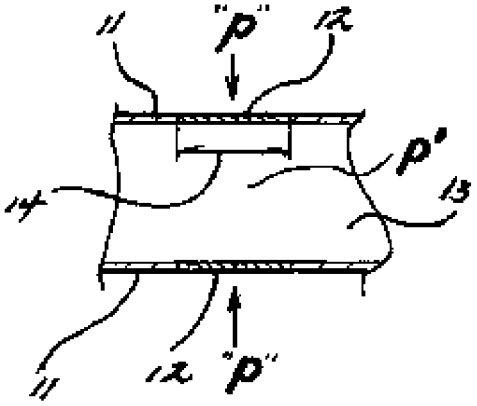

[Fig. 5]
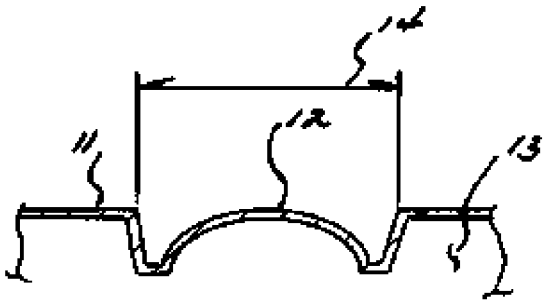

CONTAINER INTENDED FOR LIQUID AND HAVING A PRESSURE ADJUSTMENT SURFACE FOR CONSTANT DISCHARGE

This application is a 371 application of PCT/KR2012/002666 filed Apr. 9, 2012, which claims foreign priority benefit under 35 U.S.C. §119 of Korean application No. 10-2011-0032393, filed Apr. 7, 2011, the disclosure of which is incorporated herein in its entirety.

TECHNICAL FIELD

The present invention relates a liquid container having a pressure adjustment surface on a side surface thereof for constant discharge.

BACKGROUND ART

In a liquid container according to a related art, when a side surface of the liquid container is pressurized, a content within an inner space of the container is discharged through a discharge hole of a lid. Also, when the side surface of the liquid container is not pressurized, the side surface is returned to its original state. Here, there is a common technology that a portion of the contents remaining around the discharge hole of the lid is suctioned into the inner space of the container while the constricted volume of the inner space of the container is restored.

However, there is a technical defect in that the side surface has to have a predetermined thickness to ensure pressurization and restoring performances thereof.

Also, when the side surface has a too thick thickness, the elderly persons or child may be difficult to use the container. On the other hand, when the side surface has a too thin thickness, the side surface may be reduced in restoring performance to allow the contents to be stained around the discharge hole of the lid, and thus it is unsanitary.

To solve the above-described defect, a technology that a mark having a slightly recessed shape is disposed on a certain portion of the side surface of a container body, and the certain portion is constantly pressurized is proposed in a related document (see PCT/US2010/048449). However, it may not be realistic because it is uncomfortable that the user looks at and pressurizes the certain portion. Here, the certain portion, is just the mark such as a picture or a symbol.

DISCLOSURE OF THE INVENTION

Technical Problem

According to the related art disclosed in PCT/US2010/048449, when a side surface of a container body has a thin thickness, the side surface may be deteriorated in restoring performance, on the contrary, when the side surface of the container body has a thick thickness, the side surface may have an excellent restoring performance, but be difficult to use because it requires a relatively large amount of force. Therefore, to achieve the object of the present invention, a pressure adjustment surface may be disposed on a side surface of a container body to solve the limitation.

Technical Solution

A container intended for liquid and having a pressure adjustment surface for constant discharge, characterized in that the container includes a container body having an inner space and a side surface on each of front and back surfaces of the container body, a lid, which is a unit for discharging a content filled in the inner space, is coupled to an upper portion of the container body, for the use of the liquid container, when a cover integrally assembled or connected to the lid is opened, and the side surfaces of the container body are pressurized, a pressure is generated in the inner space, the content is discharged through a discharge hole of the lid due to the generate pressure, and when the side surfaces are not pressurized any more, the side surfaces are returned to its original state, and a volume of the inner space is restored, the content remaining around the discharge hole of the lid is suctioned into the inner space while the volume of the inner space is restored, and a pressure adjustment surface protrudes inward from the side surface of the container body.

The pressure adjustment surface is formed on at least one of the side surfaces of the front and back surfaces of the container body.

The pressure adjustment surface has an inside portion having a structure in which, when a force is applied to the side surface, the inside portion of the pressure adjustment surface contacts an inner wall of the side surface opposite thereto, to prevent the side surface from being further pressurized.

The pressure adjustment surface has an inside portion having a structure in which when a force is applied to the side surface, the inside portion of the pressure adjustment surface contacts an inner wall of the pressure adjustment surface of the side surface, which is opposite thereto, to prevent the side surface from being further pressurized.

The pressure adjustment surface is formed of a material having a property different from that of a material for forming the side surface, and the pressure adjustment surface is formed of a material that is softer than that of the side surface. The pressure adjustment surface may he manufactured by a multi-colored blow molding device and it is economical.

The pressure adjustment surface has a width of about 10 MM to about 20 MM or a width of about 21 MM to about 30 MM.

The pressure adjustment surface has a dome shape with respect to the side surface, and the pressure reference surface is formed inward on the side surface.

According to an aspect, a container intended for liquid and having a pressure adjustment surface for constant discharge and a structure in which a side surface of the container is pressurized by a finger to discharge a content filled in an inner space thereof, includes: a container body in which the content is filled, the container body having a structure in which front and back surfaces have areas wider that that of the side surface; a coupling unit assembled with an upper portion of the container body to discharge the pressurized content; a discharge hole defined in the coupling unit, the discharge hole including a check valve opened and closed by a predetermined pressure; and a cover for protecting the discharge hole is disposed on the coupling unit in which the discharge hole is defined.

Also, the pressure adjustment surface protrudes inward from the side surface of the container body, and an end surface of the pressure adjustment surface is spaced a predetermined distance apart from the side surface disposed on the front surface.

Alternatively, the pressure adjustment surfaces protrude inward from both side surfaces of the container body, end surfaces of the pressure adjustment surfaces face each other and are spaced a predetermined distance apart from each other.

Advantageous Effects

Since the container is not pressurized at a predetermined pressure or more by the pressure adjustment surface even though the side surface of the container has a thin thickness, a predetermined pressure may be applied to the side surface regardless of the force pushing the side surface.

BRIEF DESCRIPTION OF THE DRAWINGS

FIGS. 1 and 2 are illustrating a first embodiment of the present invention, wherein FIG. 1 is a perspective view illustrating a state in which a cover is spread, and FIG. 2 is cross-sectional view illustrating main parts of a pressurizing reference surface.

FIGS. 3 and 4 are illustrating another embodiment of the present invention, wherein FIG. 3 is a perspective view illustrating a state in which a cover is spread, and FIG. 4 is cross-sectional view illustrating main parts of a pressurizing reference surface.

FIG. 5 is a cross-sectional view illustrating a main part of a pressurizing reference surface according to further another embodiment.

MODE FOR CARRYING OUT THE INVENTION

A liquid container 1 includes a container body 10 having an inner space 13, side surfaces 11 disposed on front and back surfaces of the container body 10, and a lid 20 coupled to an upper portion of the container body 10 to discharge a content contained in the inner space 13. For the use of the liquid container 1, when a cover 24 integrally assembled or connected to the lid 20 is opened, and the side surfaces 11 of the container body 10 are pressurized, a pressure may be generated in the inner space 13, and the content may be discharged through a discharge hole 21 of the lid 20 due to the generate pressure. When the side surfaces 11 are not pressurized any more, the side surfaces 11 may be returned to its original state, and a volume of the inner space 13 is restored. Here, while the volume of the inner space 13 is restored, the contents remaining around the discharge hole 21 of the lid 220 may be suctioned into the inner space 13.

A pressure adjustment surface 12 may protrude by a predetermined depth inward from each of the side surfaces 11 of the container body 10. Here, the pressure adjustment surface 12 may be formed on at least one of the side surfaces disposed on the front and back surfaces.

Also, an inside portion of the pressure adjustment surface 12 has a structure in which when a force is applied to the side surfaces 11, the inside portion of the pressure adjustment surface 12 contacts an inner wall of the side surface 11 which is opposite thereto to prevent the side surfaces 11 from being further pressurized.

Also, the inside portion of the pressure adjustment surface 12 has a structure in which when a force is applied to the side surfaces 11, the inside portion of the pressure adjustment surface 12 contacts an inner wall of the pressure adjustment surface 12 formed on the side surface 11, which is opposite thereto, to prevent the side surfaces 11 from being further pressurized.

When the liquid container 1 is used, in a state where the lid 20 is snap-fitted or screw-coupled to a hole, which is defined in a direction in which the contents are discharged, of the container body 10 by a coupling unit 27, the cover 24 is opened in a direction by using a guide part 26. Then, when the pressure adjustment surface 12 is pressurized in a state where the discharge hole 21 of the liquid container 1 faces downward, the side surface 11 may instantly move toward the inner space 13 to generate a pressure within the inner space 13.

The generated pressure may be discharged through the narrow discharge hole 21. Here, when the pressure applied to the side surface 11 is released, the pressure adjustment surface 12 may be restored together with the side surface 11, and at the same time, the contents remaining around the discharge hole 21 may immediately move into the inner space 12.

Also, a check valve 22 formed of a silicon material, which is used as a common unit for smoothly discharging the contents, may be further disposed in the discharge hole 21.

Also, as illustrated in FIG. 2, the pressure adjustment surfaces 12 may be formed on both side surfaces 11 of the front and back surfaces of the container body 10. In FIG. 2, when a portion (hereinafter, referred to as a "pressure adjustment surface 12 of the side surface 11") on which the pressure adjustment surface 12 is formed of the side surface 11 is pressurized (see reference symbol "P"), a pressure may be generated in the inner space 13. Here, when inner surfaces of the pressure adjustment surfaces 12 contact each other, the side surfaces 11 may not move inward further to stop, thereby applying a predetermined pressure to the inner space 13.

Also, when a pressure is not applied to the pressure adjustment surface 12 of the side surface 11, the pressure adjustment surface 12 may be immediately restored together with the side surface 11 (see reference symbol "P").

In another embodiment (FIGS. 3 to 4), as illustrated in FIG. 3, the pressure adjustment surface 12 may be formed of a material having properties different from those of the material of the side surface 11. For example, the pressure adjustment surface 12 may be formed of a material softer than that of the side surface 11.

Also, the pressure adjustment surface 12 may have a width 14 of about 10 MM to about 20 MM or about 21 MM to about 30 MM. The width 14 may be variable depends on circumstances.

In further another embodiment (see FIG. 5), the pressure adjustment surface 12 may have a dome shape with respect to the side surface 11. The pressure adjustment surface 12 having a dome shape may have a diameter of about 20 MM or more.

Also, the pressure adjustment surface 12 may be formed on the side surface 11 in a state where the side surface 11 is recessed inward.

Reference numerals 23 and 25 which are not described in the present disclosure represent a connecting part and a discharge hole stopper, respectively.

INDUSTRIAL APPLICABILITY

The liquid container may be applied to various fields such as a field of daily supplies such as shampoos and conditioners, high concentration liquid containers, and so on. Particularly, when a high-concentrated flavor or scent is filled in the liquid container, a fresh beverage may be made and drunk anytime or anywhere, and thus the liquid container may be used in vitamin drinks or pharmaceutical fields.

The invention claimed is:

1. A container intended for liquid, the container comprising:

a container body having an inner space and a side surface on each of front and back surfaces of the container body, a lid coupled to an upper portion of the container body a cover, that is openable, integrally assembled or connected to the lid, wherein, when the lid is opened and one or more of the side surfaces of the container body are pressurized, a pressure is generated in the inner space and content of the container body is discharged through a discharge hole of the lid due to the generated pressure, and, when the side surfaces are not pressurized or being pressurized any more, the side surfaces are returned to an original state, a volume of the inner space is restored, and content remaining around the discharge hole of the lid is suctioned into the inner space while the volume of the inner space is restored, wherein at least one pressure adjustment surface protrudes inwardly from the side surface of the container body into the inner space of the container body, the at least one pressure adjustment surface is formed on at least one of the side surfaces of the front and back surfaces of the container body and formed inward on the at least one of the side surfaces of the front and back surfaces of the container body, the at least one pressure adjustment surface is formed of a first softer material having a property different from that of a second harder material for forming the side surface, the first softer material of the at least one pressure adjustment surface is softer than that of the second harder material of the side surface and, at a largest perimeter of the at least one pressure adjustment surface, the first softer material of the at least one pressure adjustment surface is surrounded by the second harder material of the side surface, and the at least one pressure adjustment surface has an inner surface facing the inner space of the container body and having a structure in which, when a force is applied to the side surface, the inner surface of the at least one pressure adjustment surface contacts an inner wall of the side surface opposite thereto, to prevent the side surface from being further pressurized.

2. The container of claim 1, the at least one pressure adjustment surface has a width of about 10 MM to about 20 MM.

3. The container of claim 1, wherein the at least one pressure adjustment surface has a width of about 21 MM to about 30 MM.

4. The container of claim 1, wherein the at least one pressure adjustment surface has a dome shape with respect to the side surface.

5. A container intended for liquid and having a structure in which a side surface of the container is manually pressurized to discharge a content filled in an inner space thereof, the container comprising:

a container body in which the content is filled, the container body having a structure in which front and back surfaces have areas wider than that of the side surface;

a lid positioned at or near an upper portion of the container body;

a discharge hole defined in the lid, the discharge hole comprising a check valve opened and closed by a predetermined pressure; and a cover for protecting the discharge hole disposed on the lid in which the discharge hole is defined, wherein at least one pressure adjustment surface protrudes inward from a first side surface of the container body, and an inner surface of the at least one pressure adjustment surface, facing the inner space of the container body, is spaced a predetermined distance apart from a second side surface disposed opposite with respect to the first side surface, and further wherein the at least one pressure adjustment surface is formed of a first softer material having a property different from that of a second harder material for forming other side surfaces of the container body, the first softer material of the at least one pressure adjustment surface is softer than that of the second harder material of the other side surfaces and, at a largest perimeter of the at least one pressure adjustment surface, the first softer material of the at least one pressure adjustment surface is surrounded by the second harder material of the other side surfaces, and the inner surface of the at least one pressure adjustment, facing the inner space of the container body, has a structure in which, when a force is applied to the first side surface, the inner surface of the at least one pressure adjustment surface contacts an inner wall of the side surface opposite thereto, to prevent the first side surface from being further pressurized.

6. A container intended for liquid and having a structure in which a side surface of the container is manually pressurized to discharge a content filled in an inner space thereof, the container comprising:

a container body in which the content is filled, the container body having a structure in which front and back surfaces have areas wider than that of the side surface;

a lid positioned at or near an upper portion of the container body;

a discharge hole defined in the lid, the discharge hole comprising a check valve opened and closed by a predetermined pressure; and a cover for protecting the discharge hole is disposed on the lid in which the discharge hole is defined, wherein pressure adjustment surfaces protrude inward from both front and back surfaces of the container body, inner surfaces of the pressure adjustment surfaces face each other and are spaced a predetermined distance apart from each other, and further wherein the pressure adjustment surfaces are formed of a first softer material having a property different from that of a second harder material for forming the side surface of the container body, the first softer material of the pressure adjustment surfaces is softer than that of the second harder material of the other side surfaces and, at a largest perimeter of the at least one pressure adjustment surface, the first softer material of the at least one pressure adjustment surface is surrounded by the second harder material of the other side surfaces, and the inner surfaces of the pressure adjustment surfaces, facing the inner space of the container, have a structure in which, when a force is applied to the side surface, the inner surfaces of the pressure adjustment surfaces contact each other to prevent the side surface from being further pressurized.

* * * * *